US006299010B1

(12) United States Patent
Hsu

(10) Patent No.: US 6,299,010 B1
(45) Date of Patent: Oct. 9, 2001

(54) DIY KNOCKDOWN WASTE PAPER BASKET

(75) Inventor: Pey-Son Hsu, Changhua Hsien (TW)

(73) Assignee: Ching Feng Blinds Ind. Co., Ltd., Changhua Hsien (TW)

( * ) Notice: Subject to any disclaimer, the term of this patent is extended or adjusted under 35 U.S.C. 154(b) by 0 days.

(21) Appl. No.: 09/711,927

(22) Filed: Nov. 15, 2000

(51) Int. Cl.[7] ..... B65F 1/14
(52) U.S. Cl. ..... 220/4.09; 220/4.08
(58) Field of Search ..... 220/908, 4.08, 220/4.09, 4.04, 4.01, 4.05, 4.28, 62

(56) References Cited

U.S. PATENT DOCUMENTS 1,125,822 * 1/1915 Dodds .
1,500,917 * 7/1924 Bell .
1,852,281 * 4/1932 Bell .
1,976,209 * 10/1934 Ashe .
5,056,679 * 10/1991 Lonczak .
5,372,269 * 12/1994 Sutton et al. .

FOREIGN PATENT DOCUMENTS

561706 * 10/1932 (GB) .

* cited by examiner

*Primary Examiner*—Stephen Castellano
(74) *Attorney, Agent, or Firm*—Dougherty & Troxell

(57) ABSTRACT

DIY knockdown waste paper basket including an upper frame, two wall sheets and a base seat. The upper frame defines a central opening. A bottom face of the upper frame is formed with two downward extending annular stop walls. The two stop walls define therebetween a fitting groove. Two sides of each of the wall sheets are respectively formed with multiple interlaced latch plates at equal intervals. The latch plates define therebetween multiple latch recesses. An upper and a lower sides of a root section of each latch plate are respectively cut with two arch latch notches, whereby the upper and lower corners of the root section of each latch plate are respectively formed with two latch projections corresponding to the latch notches. A middle portion of lower edge of the wall sheet is formed with an L-shaped engaging fissure. A top face of the base seat is formed with two upward extending annular stop walls. The two stop walls define therebetween a fitting groove. An inner circumference of the outer stop wall of the base seat is formed with two opposite engaging blocks. By means of the engagement between the latch projections and the latch notches, the latch plates are prevented from slipping out of the latch recesses so that the two wall sheets are more firmly assembled into a basket body with better roundness. Moreover, the waste paper basket can be more easily and quickly disassembled for storage.

1 Claim, 5 Drawing Sheets

DIY KNOCKDOWN WASTE PAPER BASKET

BACKGROUND OF THE INVENTION

The present invention relates to a DIY knockdown waste paper basket in which by means of the engagement between the latch projections and the latch notches of the latch plates of the wall sheets, the wall sheets are prevented from resiliently bounding back. The wall sheets are more formly assembled into a basket body without using any click block so that the basket body has better roundness and can be more easily and quickly assembled and disassembled.

FIG. 1 shows a conventional DIY knockdown waste paper basket which includes an upper frame 10, two wall sheets 20, a base seat 30 and two click blocks 40. The upper frame 10 defines a central opening 11. The bottom face of upper frame 10 is formed with two downward extending annular stop walls 12. The two stop walls 12 define therebetween a fitting groove 13. Each wall sheet 20 is a rectangular flexible sheet body. One side of the wall sheet 20 is formed with multiple outward extending insertion plates 21 at equal intervals. The other side of the wall sheet 20 is formed with multiple insertion slits 22 at equal intervals corresponding to the insertion plates 21. The middle of lower edge of the wall sheet 20 is formed with a latch hole 23. The top face of the base seat 30 is formed with two upward extending annular stop walls 31. The two stop walls 31 define therebetween a fitting groove 32. The circumference of the stop walls 31 are formed with two opposite latch holes 33. Each click block 40 includes a button 41 and two reverse hook-like resilient latch hooks 42 extending from inner side of the button 41.

When assembled, as shown in FIG. 2, the insertion plates 21 (or insertion slits 22) of one wall sheet 20 are first inserted into and connected with the insertion slits 22 (or insertion plates 21) of the other wall sheet 20 so as to assemble the two wall sheets 20 into a substantially cylindrical basket body 1. Then the bottom end of the cylindrical basket body 1 is inlaid into the annular fitting groove 32 of the base seat 30 with the latch holes 23 aligned with the latch holes 33 of the base seat 30. Then the resilient latch hooks 42 of the two click blocks 40 are inward passed through the latch holes 23, 33 of the cylindrical basket body 1 and the base seat 30 so as to fasten the cylindrical basket body 1 on the base seat 30. Finally, the upper frame 10 is mated with the cylindrical basket body 1 with the top end of the cylindrical basket body 1 fitted into the annular fitting groove 13 of the upper frame 10 to complete the assembly.

The above arrangement has some shortcomings as follows:

1. The wall sheets 20 are assembled into the basket body 1 by means of insertion. The wall sheets 20 are resiliently flexible and the insertion plates 21 are not restricted by any restricting section. Therefore, after assembled and when the external force is removed, the insertion plates 21 are poorly fixed in the insertion slits 22 and the insertion plates 21 may further slip out of the insertion slits 22 to make the basket body 1 disassembled.

2. After the wall sheets 20 are assembled into the basket body 1, the wall sheets 20 will slightly restore. In addition, the insertion plates 21 of the wall sheet 20 are intruded into the insertion slits 22 so that the roundness of the basket body 1 is poor (as shown in FIG. 3). As a result, the appearance of the basket body 1 as a whole is poor.

3. It is necessary to use the click blocks 40 for truly fastening the basket body 1 with the base seat 30 so that the structure is complicated. Moreover, when disassembled, it is necessary to outward press the click blocks 40 out of the latch holes. Such procedure can be hardly easily and quickly performed.

SUMMARY OF THE INVENTION

It is therefore a primary object of the present invention to provide a DIY knockdown waste paper basket in which by means of the engagement between the latch projections and the latch notches, the two wall sheets are firmly assembled into a truly cylindrical basket body. After assembled and when the external force is removed, the latch projections are kept latched in the latch notches so that the latch plates are prevented from slipping out of the latch recesses due to resiliently restoring force. Therefore, the two wall sheets are more easily and firmly assembled into the basket body with a better rigidity.

It is a further object of the present invention to provide the above DIY knockdown waste paper basket in which after assembled, the latch projections are latched in the latch notches and the wall sheets are prevented from resiliently bounding back so that the basket body will have abetter roundness. Therefore, the waste paper basket has a better appearance.

It is still a further object of the present invention to provide the above DIY knockdown waste paper basket in which when assembling the basket body with the base seat, a user only needs to align the engaging fissure with the engaging block of the base seat and rotarily lock the engaging fissure with the engaging block for fastening the basket body on the base seat. Therefore, no click block is necessary and the structure as a whole is simplified. Also, the waste paper basket can be more easily and quickly disassembled for storage.

The present invention can be best understood through the following description and accompanying drawings wherein:

DETAILED DESCRIPTION OF THE PREFERRED EMBODIMENT

Figure 1:
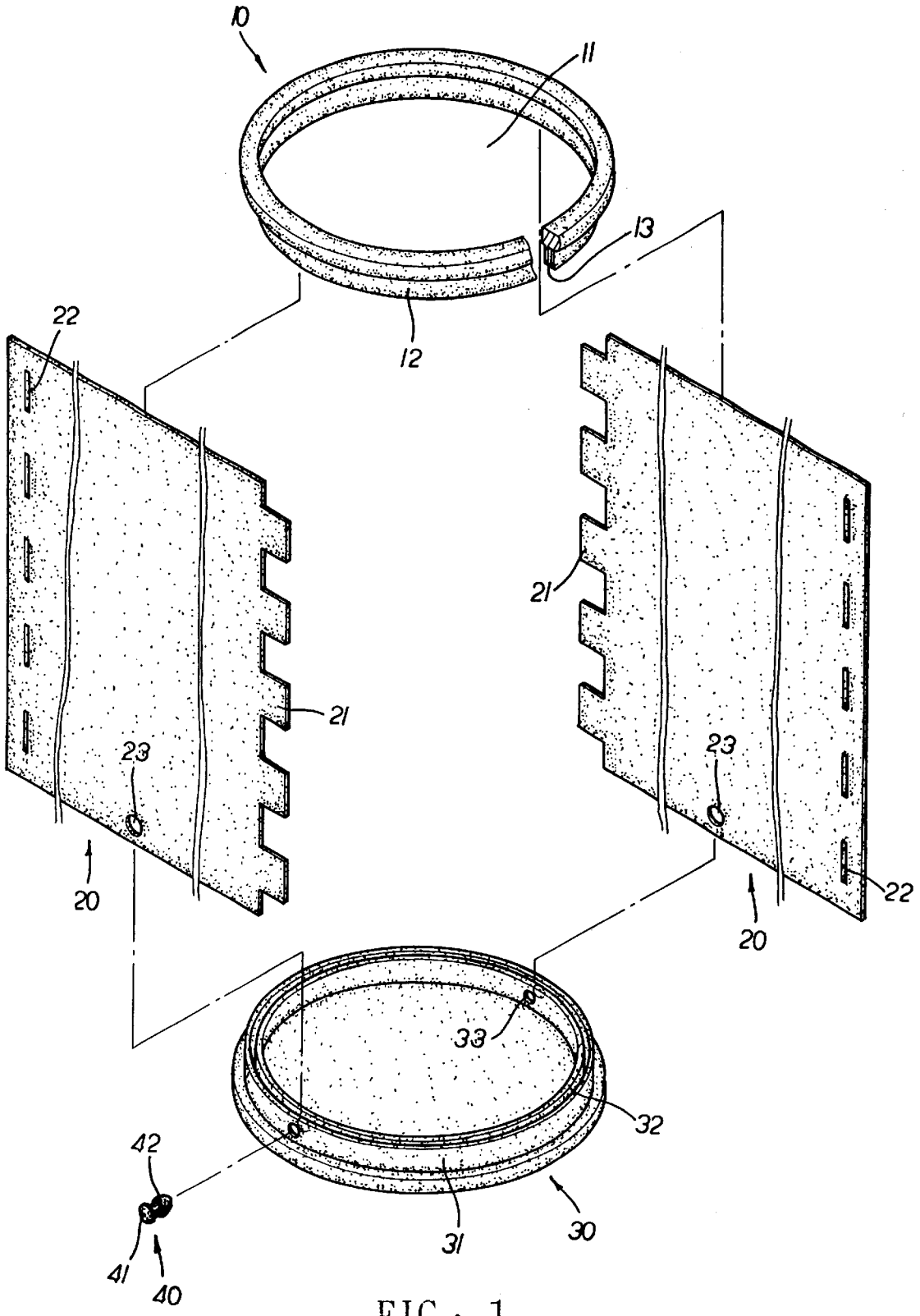
FIG. 1 is a perspective exploded view of a conventional DIY knockdown waste paper basket.
Figure 3:
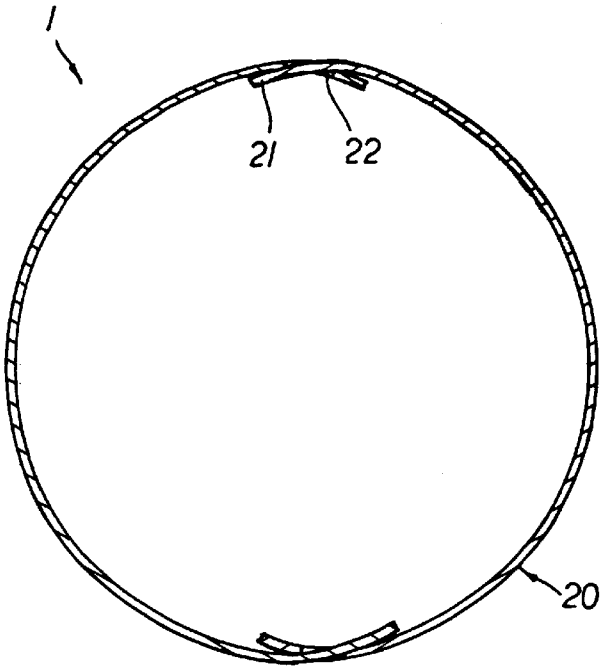
FIG. 3 is a top sectional view of the conventional DIY knockdown waste paper basket, showing the roundness thereof.
Figure 2:
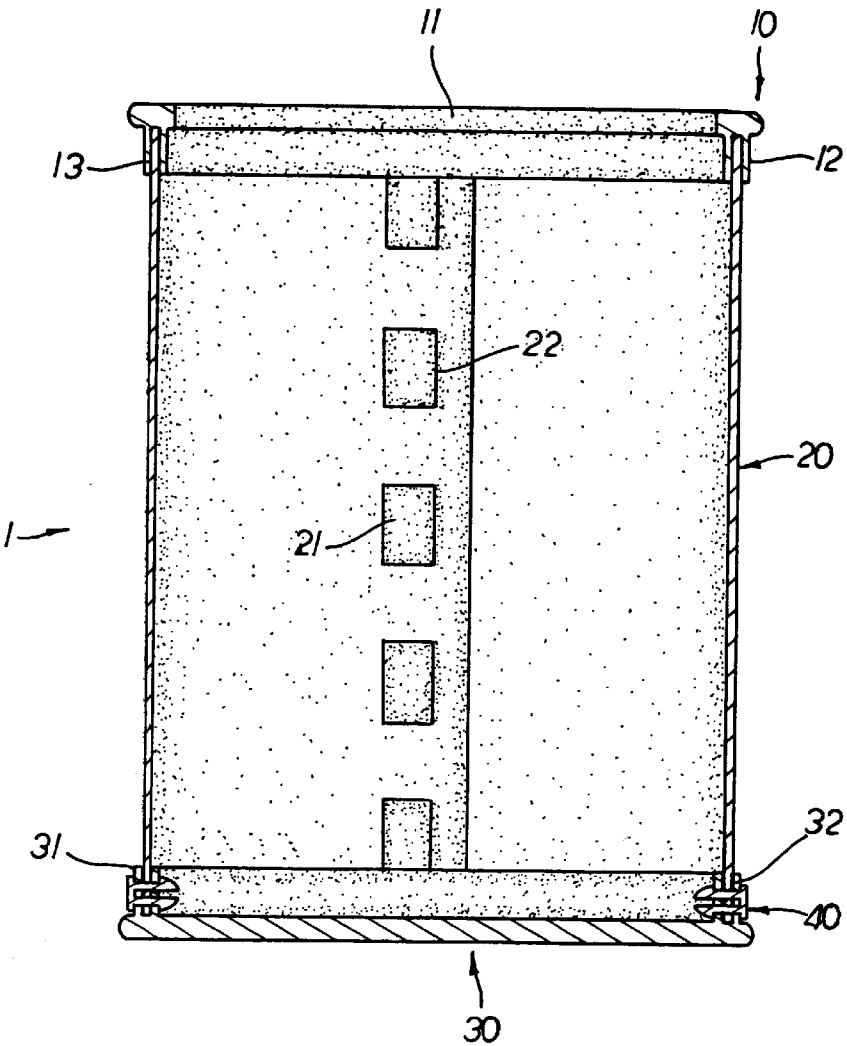
FIG. 2 is a sectional assembled view of the conventional DIY knockdown waste paper basket.
Figure 4:
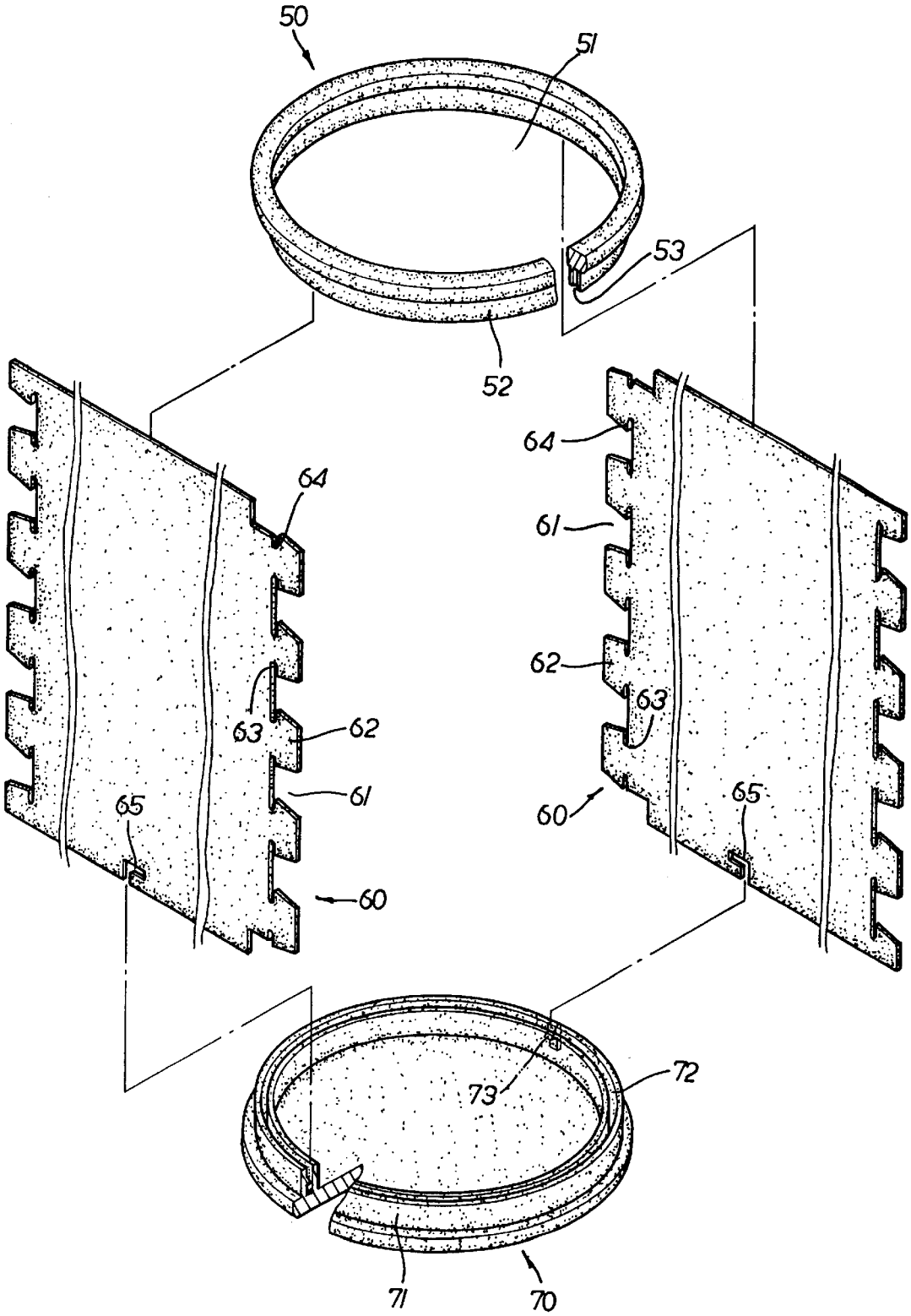
FIG. 4 is a perspective exploded view of the DIY knockdown waste paper basket of the present invention.

Please refer to FIG. 4. The DIY knockdown waste paper basket of the present invention includes an upper frame 50, two wall sheets 60 and a base seat 70. The upper frame 50 defines a central opening 51. The bottom face of the upper frame 50 is formed with two downward extending annular stop walls 52. The two stop walls 52 define therebetween a fitting groove 53. Each wall sheet 60 is a rectangular flexible sheet body. Two sides of the wall sheet 60 are respectively formed with multiple interlaced trapezoid latch plates 62 at equal intervals. The latch plates 62 are outward tapered and define therebetween multiple trapezoid latch recesses 61.

The upper and lower sides of a root section of each latch plate 62 are respectively cut with arch latch notches 63 communicating with the bottom of the latch recess 61. Accordingly, the upper and lower corners of the root section of each latch plate 62 are respectively formed with two latch projections 64. The middle of lower edge of the wall sheet 60 is formed with an L-shaped engaging fissure 65. The top face of the base seat 70 is formed with two upward extending annular stop walls 71. The two stop walls 71 define therebetween a fitting groove 72. The inner circumference of the outer stop wall 71 is formed with two opposite engaging blocks 73.

Figure 5:
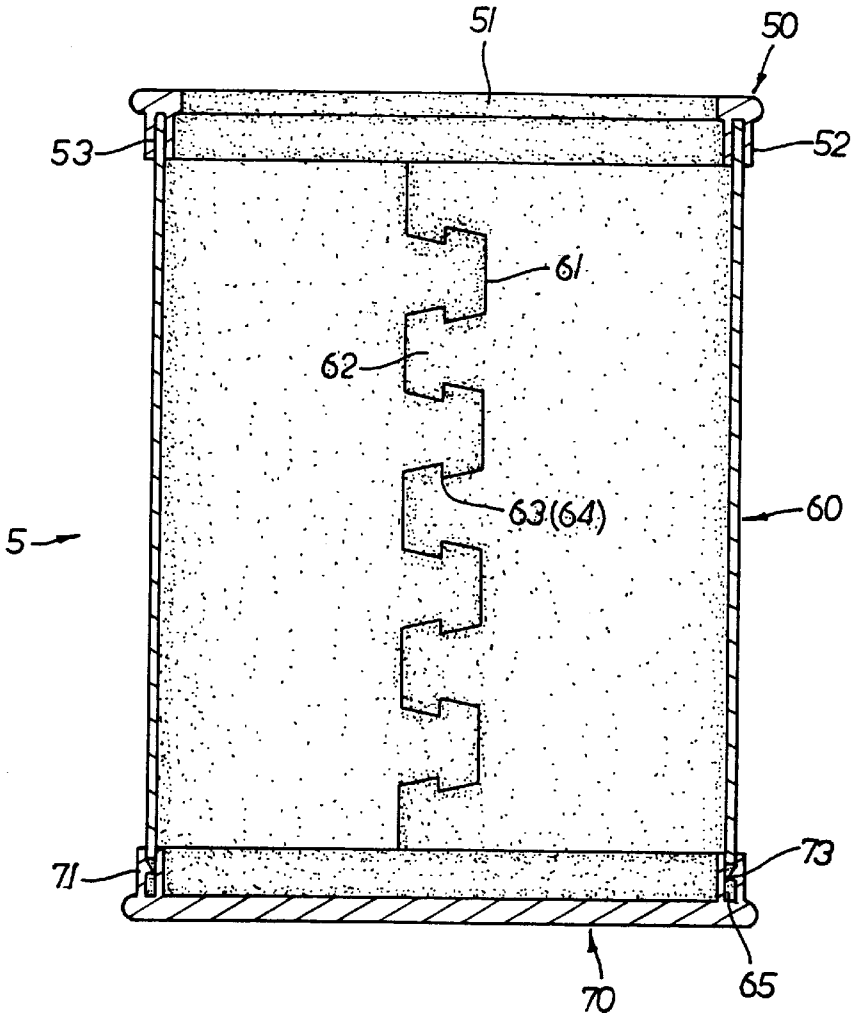
FIG. 5 is a sectional assembled view of the DIY knockdown waste paper basket of the present invention.
Figure 6:
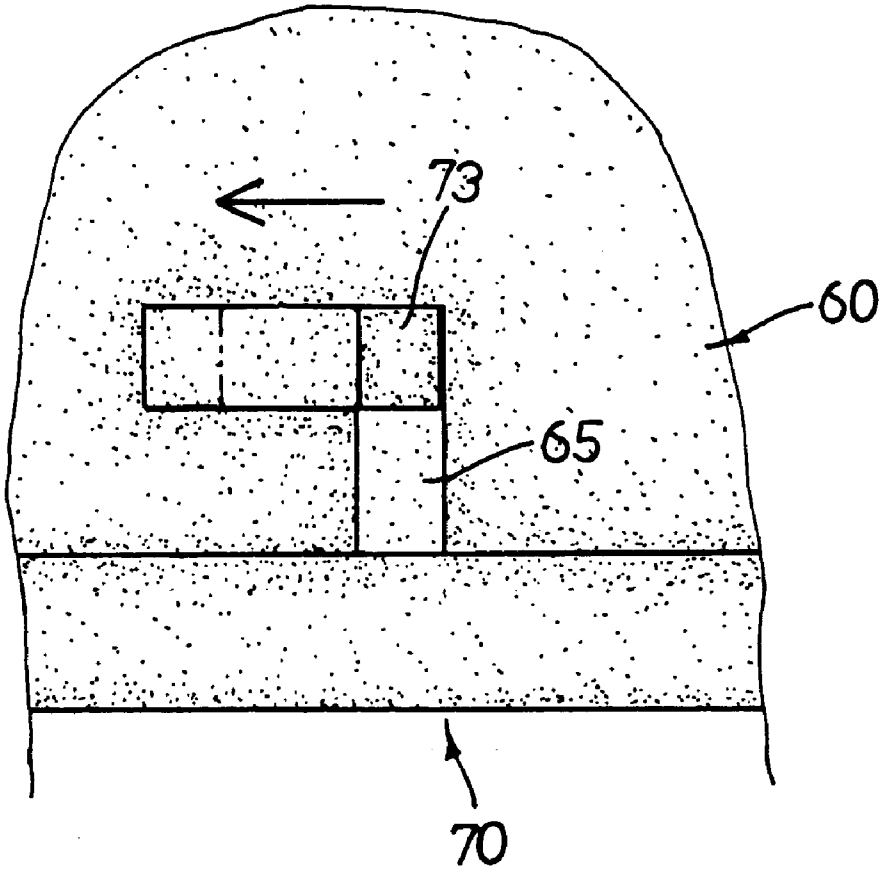
FIG. 6 is an enlarged view showing the assembling operation of the DIY knockdown waste paper basket of the present invention.

When assembled, as shown in FIG. 5, the latch plates 62 (or latch recesses 61) of one wall sheet 60 are first latched with the latch recesses 61 (or latch plates 62) of the other wall sheet 60. At this time, the latch projections 64 are smoothly slided into and latched with the arch latch notches 63. By means of the engagement between the latch projections 64 and the latch notches 63, the latch plates 62 are prevented from slipping out of the latch recesses 61 due to resiliently restoring force so that the two wall sheets 60 are firmly assembled into a truly cylindrical basket body 5. Then the bottom end of the basket body 5 is fitted into the annular fitting groove 72 of the base seat 70. In addition, the engaging fissures 65 are aligned with the engaging blocks 73 of the base seat 70 and rotarily locked therewith (as shown in FIG. 6). Accordingly, the basket body 5 is firmly fastened on the base seat 70. Finally, the upper frame 50 is mated with the basket body 5 with the top end of the basket body 5 fitted into the annular fitting groove 53 of the upper frame 50 to complete the assembly.

According to the above arrangement, the present invention has the following advantages:

1. By means of the engagement between the latch projections 64 and the latch notches 63, the two wall sheets 60 are firmly assembled into a truly cylindrical basket body 5. After assembled and when the external force is removed, the latch projections 64 are kept latched in the latch notches 63 so that the latch plates 62 are prevented from slipping out of the latch recesses 61 due to resiliently restoring force. Therefore, the two wall sheets 60 are more easily and firmly assembled into the basket body with a better rigidity.

Figure 7:
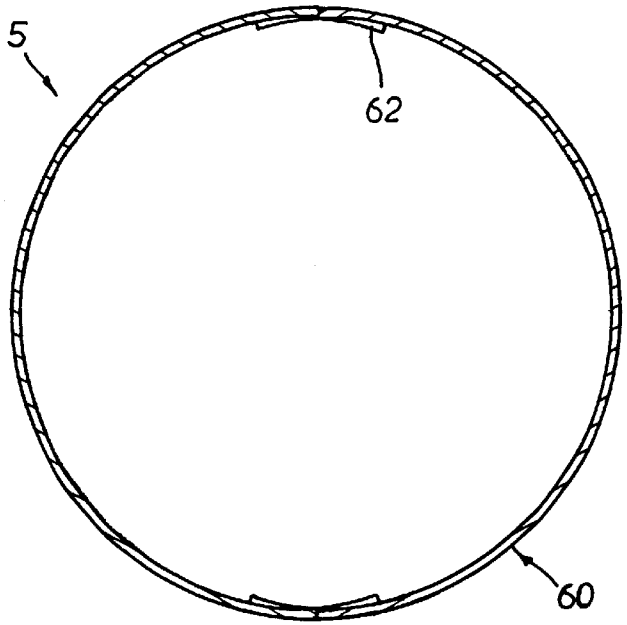
FIG. 7 is a top sectional view of the DIY knockdown waste paper basket of the present invention, showing the roundness thereof.

2. After assembled, the latch projections 64 are latched in the latch notches 63 and the wall sheets 60 are prevented from resiliently bounding back so that the basket body 5 will have a better roundness (as shown in FIG. 7). Therefore, the waste paper basket has a better appearance.

3. When assembling the basket body 5 with the base seat 70, a user only needs to align the engaging fissure 65 with the engaging block 73 of the base seat 70 and rotarily lock the engaging fissure 65 with the engaging block 73 for fastening the basket body 5 on the base seat 70. Therefore, the click blocks 40 are no more necessary and the structure as a whole is simplified. Also, the waste paper basket can be more easily and quickly disassembled for storage.

The above embodiment is only used to illustrate the present invention, not intended to limit the scope thereof. Many modifications of the above embodiment can be made without departing from the spirit of the present invention.

What is claimed is:

1. DIY knockdown waste paper basket comprising an upper frame, two wall sheets and a base seat, the upper frame defining a central opening, a bottom face of the upper frame being formed with two downward extending annular stop walls, the two stop walls defining therebetween a fitting groove, a top face of the base seat being formed with two upward extending annular stop walls, the two stop walls defining therebetween a fitting groove, said waste paper basket being characterized in that:

two sides of each of the wall sheets are respectively formed with multiple interlaced latch plates at equal intervals, the latch plates defining therebetween multiple latch recesses, an upper and a lower sides of a root section of each latch plate being respectively cut with two arch latch notches, whereby the upper and lower corners of the root section of each latch plate are respectively formed with two latch projections corresponding to the latch notches, a middle portion of lower edge of the wall sheet being formed with an L-shaped engaging fissure;

an inner circumference of the outer stop wall of the base seat is formed with two opposite engaging blocks; and the latch plates and latch recesses of the wall sheets are latched with each other with the latch projections latched in the latch notches so that the wall sheets are assembled into a basket body, the bottom end of the basket body being fitted into the annular fitting groove of the base seat, the engaging fissures of the basket body being aligned with the engaging blocks of the base seat and rotarily locked with the engaging block for firmly fastening the basket body on the base seat.

* * * * *